United States Patent [19]

Thomas et al.

[11] Patent Number: 4,938,143

[45] Date of Patent: Jul. 3, 1990

[54] BOOSTER SHAPED FOR HIGH-EFFICIENCY DETONATING

[75] Inventors: Ronald D. Thomas, Woodland Hills; Robert W. Levan, Orem, both of Utah

[73] Assignee: Trojan Corporation, Salt Lake City, Utah

[21] Appl. No.: 306,810

[22] Filed: Feb. 3, 1989

Related U.S. Application Data

[63] Continuation of Ser. No. 44,513, Apr. 29, 1987, abandoned.

[51] Int. Cl.[5] ..... F42B 3/00

[52] U.S. Cl. ..... 102/318; 102/275.4; 102/313; 102/332

[58] Field of Search ..... 102/313, 318, 332, 331, 102/275.4, 275.12

[56] References Cited

U.S. PATENT DOCUMENTS

| | | | |
|---|---|---|---|
| Re. 30,621 | 5/1981 | Calder et al. | 102/318 |
| 422,439 | 3/1890 | Peters | 102/331 |
| 2,475,875 | 7/1949 | Burrows et al. | 102/312 |
| 2,689,008 | 9/1954 | Allen et al. | 166/286 |
| 2,698,575 | 1/1955 | Poulter | 102/332 |
| 2,837,997 | 6/1958 | Woods | 102/318 |
| 3,037,452 | 6/1962 | Cook et al. | 102/331 |
| 3,037,453 | 6/1962 | Cook et al. | 102/331 |
| 3,070,010 | 12/1962 | Robinson | 102/306 |
| 3,170,366 | 2/1965 | Alfredsson | 102/313 |
| 3,185,017 | 5/1965 | Cook et al. | 102/318 |
| 3,228,065 | 1/1966 | Cournoyer et al. | 366/76 |
| 3,256,814 | 6/1966 | Kruppenbach et al. | 102/318 |
| 3,285,172 | 11/1966 | Foster | 102/318 |

(List continued on next page.)

FOREIGN PATENT DOCUMENTS

| | | |
|---|---|---|
| 891012 | 1/1972 | Canada . |
| 2079265 | 1/1982 | United Kingdom . |

OTHER PUBLICATIONS

Wasson, D., "New Boosters for Blasting Agents" (circa 1984).

Junk, N. M., "The Role of Detonation Pressure in Blasting and Priming" (circa 1981).

Bryson, B., "The Role of Detonation Pressure and Primer Diameter in Initiating ANFO: A Review" (circa 1980).

"Puzzled About Primers for Large-Diameter ANFO Charges? Here's Some Help to End the Mystery," COAL AGE, pp. 102-107 (Aug. 1976).

Hagan, T., "Optimum Priming Systems for Ammonium Nitrate/Fuel Oil-Type Explosives," Australian Institute of Mining and Manufacturing Conference, pp. 283-297 (Jul. 1974).

United States Bureau of Mines, "Effects of Primer Type and Borehole Diameter on AN-FO Detonation Velocities," MINING CONGRESS JOURNAL, pp. 46-52 (Jun. 1974).

*Primary Examiner*—David H. Brown

*Attorney, Agent, or Firm*—Workman, Nydegger & Jensen

[57] ABSTRACT

A booster for high efficiency initiation of an explosive material comprising a body portion having substantially tapered sides and a substantially flat interface surface at the larger end of the body portion extending generally laterally thereof for contacting the explosive material. A plurality of passageways may be formed in the booster to receive a means for detonating same. When compared with traditional cylindrical boosters of either equal weight or equally sized interface surfaces, the disclosed booster resulted in shorter run-up distance and a more effective release of explosive energy. Although, numerous geometric configurations of the booster are disclosed, a presently preferred embodiment thereof takes the shape of a conical frustum, the larger planar surface of which is to be oriented as the interface surface toward the explosive material to be detonated.

27 Claims, 9 Drawing Sheets

U.S. PATENT DOCUMENTS

| | | | |
|---|---|---|---|
| 3,295,445 | 1/1967 | Ball et al. | 102/311 |
| 3,341,382 | 9/1967 | Cook et al. | 149/15 |
| 3,371,606 | 3/1968 | Cook et al. | 102/318 |
| 3,431,849 | 3/1969 | Kern et al. | 102/318 |
| 3,431,851 | 3/1969 | Kern et al. | 102/318 |
| 3,447,980 | 6/1969 | Voigt | 149/105 |
| 3,491,688 | 1/1970 | Clay et al. | 102/305 |
| 3,511,538 | 5/1970 | Guenter | 102/313 |
| 3,604,354 | 9/1971 | Brown et al. | 102/332 |
| 3,645,205 | 2/1972 | Dowling | 102/318 |
| 3,736,875 | 6/1973 | Bucklischch | 102/318 |
| 3,789,760 | 2/1974 | Griffith | 102/331 |
| 3,880,080 | 4/1975 | Cook | 102/318 |
| 3,955,504 | 4/1976 | Romney | 102/331 |
| 3,971,318 | 7/1976 | Burkle | 102/318 |
| 4,290,486 | 9/1981 | Regalbuto | 166/297 |
| 4,343,663 | 8/1982 | Breza et al. | 149/4 |
| 4,376,083 | 3/1983 | Ulsteen | 149/6 |
| 4,512,418 | 4/1985 | Regalbuto et al. | 175/4.56 |
| 4,527,482 | 7/1985 | Hynes | 102/318 |
| 4,615,271 | 10/1986 | Hutchinson | 102/318 |
| 4,637,312 | 7/1987 | Adams et al. | 102/275.12 |

BOOSTER SHAPED FOR HIGH-EFFICIENCY DETONATING

This is a continuation of application Ser. No. 44,513, filed on Apr. 29, 1987, now abandoned.

BACKGROUND OF THE INVENTION

1. Field of the Invention

This invention relates to boosters employed to detonate explosive materials, such as are used in mining, construction, and seismic activity, and more specifically, to explosive boosters that effect optimally efficient detonation of such explosive materials. The present invention has particular applicability to the cast primer type of explosive booster.

2. Background Art

In the use of explosives in mining, construction, and seismic research, it is presently preferred to employ as an explosive material a blasting agent which is less sensitive, and accordingly significantly safer to handle and store, than propellants or high explosives. Such a blasting agent suitable for use in the mining industry is ANFO, a mixture of ammonium nitrate and fuel oil. This material resists detonation when exposed to shock or heat of a degree common to the mining environment. It is also relatively inexpensive.

Nevertheless, due to its insensitive nature, a blasting agent can only be detonated in conjunction with a small quantity of a more sensitive or powerful explosive material which is used to initiate the process. Typically, two components are involved in initiating the detonation of an explosive material. The first of these components is directly stimulated from a control device in order to initiate the explosion. Such components include blasting caps and detonating cords. In the former, a highly explosive material is concentrated in a small package at the end of a cable. The cable is capable of communicating an electrical or other type of stimulus to the blasting cap from the detonation control device. A detonating cord, by contrast, is actually a continuous thread of highly explosive material. A detonating cord detonates along its length in a progressive manner, once a stimulus for detonation is applied at one end. Both blasting caps and detonating cords permit safe, remote initiation of explosions, but neither is of itself capable of generating adequate energy to start the detonation of a relatively insensitive blasting agent.

Therefore, a second component in the blast initiating process is interposed between the explosive and the blasting cap or detonating cord. This interposed element of blast initiation is the booster or primer. A booster functions to amplify the energy of a blasting cap or detonating cord into an explosion sizable enough to initiate the detonation of a relatively insensitive explosive material. Boosters are made of high energy materials adequately sensitive to be detonated by a blasting cap or a detonating cord. Having a larger mass and more explosive energy than blasting caps or detonating cords, a booster will upon detonation produce enough energy to initiate explosive reactions in an adjacent explosive material. A booster is thus critical in most successful explosive operations as an intermediary between blasting caps or detonating cords and a relatively insensitive explosive material.

A typical configuration of the elements of an explosive detonation used in mining, construction, or seismic research is shown in FIG. 1. There a borehole 10 has been drilled to a preselected depth in a rock formation 12 which is to be shattered by explosives, possibly to prepare it for subsequent mechanical removal. A primer or booster 14 has been lowered to the end 16 of borehole 10. By way of illustration, operably engaged with booster 14 is a blasting cap 18 at the end of an electrical conductor 20 which leads to a detonation box 22 or other appropriate detonation control device. With booster 14 and blasting cap 18 thus disposed at the bottom 16 of borehole 10, a suitable blasting agent 24 has been poured into borehole 10 contacting booster 14.

Operation of detonating box 22 will set off blasting cap 18 which in turn detonates primer 14. This detonation releases energy adequate to initiate detonation of blasting agent 24. The entire process is completed within a few milliseconds. In order to contain and drive laterally into rock formation 12 the explosive force of blasting agent 24, the open end 26 of borehole 10 has been stemmed with backfill 28.

Rock formation 12 in which borehole 10 was drilled and equipped for explosive detonation as shown in FIG. 1 could have been at the surface of the ground, at the bottom of a mining pit, or underground at the working face of a mine. Typically an array of boreholes, such as borehole 10, is prepared together in a rock formation before any detonation occurs. Then the columns of blasting agent in the borehole matrix are detonated simultaneously or in a nearly simultaneous or patterned progression of detonations according to the specific consequences sought. The depth of borehole 10 and the height of the column of blasting agent 24 placed therein are dictated by the nature of rock formation 12, as well as the objectives of the blasting exercise.

Since the late nineteenth century, boosters used for the purposes of the initiating explosions have been nitroglycerine products. By accident of circumstances, the shape of these highly explosive products mirrored the surrounding boreholes in which they were most commonly used. As a result they were shaped into elongated cylinders, typically two inches in diameter by eight inches in length or five inches in diameter by twenty-five inches in length.

In the late 1950's and early 1960's, new powerful booster materials were developed which could be cast into various shapes. The boosters into which these materials were made were termed cast primers, because of the method of their manufacture. Cast primers continued, however, to be produced in the traditional elongated cylindrical shape into which boosters had previously been formed. A typical cast primer weighing approximately one pound is two inches in diameter and five inches in length. A common cast primer composition available under the trade name SuperPrime® is currently marketed by the Trojan Corporation. SuperPrime® is comprised of Pentolite, a mixture of PETN and TNT.

FIG. 2A shows a cross-section of a booster 30 having such a traditional elongated cylindrical shape. Booster 30 has sides 32 of height H which is usually substantially greater than the diameter D of congruent circular top end 34 and bottom end 36. Formed in booster 30 is a longitudinally disposed passageway 38 traversing the height H of booster 30 between top end 34 and bottom end 36 thereof. In addition, a dead-end passageway 40 is formed in booster 30 parallel to passageway 38 and opening onto bottom end 36 exclusively.

Passageway 38 and dead-end passageway 40 cooperate to receive a means for detonating booster 30. As shown by way of example in FIG. 2A, a blasting cap 42 has been installed in dead-in passageway 40 with its associated conductor 44 emerging from booster 30 at top end 34 thereof through passageway 38.

Explosive boosters capable of housing a dead-end passageway, such as dead-end passageway 40, are termed high-profile boosters. The properties of the material of which a booster is fabricated and purpose to which the booster is applied are factors that determine how short a high-profile booster of that material can be. Generally, the height H of high-profile boosters ranges upwardly from a minimum of 4.5 inches.

Boosters, such as booster 30, are normally installed in boreholes with the sides 32 thereof parallel to the sides of the borehole. Top end 34 is directed toward and in contact with the explosive material which the booster is intended to detonate. Top end 34 of booster 30, in contrast with sides 32 thereof, functions as the primary surface of booster 30 that interfaces with the explosive material 24. As used herein the term "interface surface" will be employed to refer to the primary surface of a booster that would customarily be installed directed toward and in contact with the explosive material to be detonated.

FIG. 2B depicts a low-profile booster 50 having sides 52 of height H and symmetric circular top end 54 and bottom end 56 of diameter D. While in FIG. 2B, booster 50 is depicted as having a height H less than diameter D, it is not necessarily the relative relationship of these two dimensions which determines whether or not a booster is considered low-profile. Rather, as discussed above, it is the properties of the material of which the booster is made and the purpose for which the booster is used that ultimately determine whether a booster of a given height H must be low-profile.

Lacking dead-end passageways, such as dead-end passageway 40 in FIG. 2A, low-profile boosters cannot operably engage a blasting cap, but can be used only in conjunction with detonating cords. Booster 50, being a low-profile booster, is shown as including only a single passageway 57 longitudinally disposed therein between top end 54 and bottom end 56. Either top end 54 or bottom end 56 of low-profile booster 50 could be used as an interface surface. The installation of a blasting cord 58 in passageway 57 with a retaining knot 59 at bottom end 56 of booster 50 would commonly result, however, in top end 54 being the interface surface for booster 50.

The need to employ detonating cords with low-profile boosters severely limits the circumstances in which they can be used. Low-profile boosters continue, however, to mirror the shape of the boreholes in which they are commonly used, as in the ultimate analysis, even with their truncated heights, low-profile boosters are cylindrical in shape.

The cylindrical shape in boosters continues to be in evidence in the hybrid booster 60 shown in FIG. 2C. Booster 60 is comprised of a cylindrical portion 62, reminiscent of a low-profile booster, joined to a high-profile cylindrical portion 64. A longitudinally disposed passageway is formed in booster 60 between circular top end 68 of diameter D and small bottom end 70. Low-profile portion 62 and high-profile portion 64 together, however, have a combined height H which is large enough to permit the formation in booster 60 of a dead-end passageway 72 suitable for receiving a blasting cap in operable engagement with booster 60. The interface surface for booster 60 would correspond under normal usage to top surface 68.

Hybrid boosters, such as booster 60, retain the unlimited utility of high-profile boosters, but they are plagued by difficulties relating to their method of manufacture, which necessitates roughly twice the manufacturing steps required to make traditional single-diameter cylindrical booster. Hybrid boosters have accordingly been perceived as overly expensive in relation to any benefits otherwise derivable therefrom.

The energy generated by the detonation of a booster travels outwardly therefrom in the form of a shockwave front which is intended to enter an explosive material and propagates therethrough. The shockwave front itself produces a corresponding traveling region of local compression of the explosive material. Compression creates conditions in which the chemical decomposition of the explosive material into gases can occur. Therefore, behind any adequately intense shockwave front passing through an explosive material is a region of expanding gases in which explosion is taking place. The boundary between the compression region and the explosive region is the detonation wave front of the explosion, which also travels through the explosive material as detonation progresses.

The detonation wave front for any given explosion has a velocity which varies with time over the nonetheless short duration of that explosion. As the detonation wave front is a moving wave front, this means that temporal variations in detonation wave velocity can simultaneously be described as variations correlated to the position of the detonation wave front in the exploding material. A common point of reference for this spatial aspect of detonation wave front velocity variation is the distance from the interface surface or top of the booster that initiated the explosion. The detonation wave front velocity in an explosive material is affected by the nature of that material, the shape in which the material is confined, and the intensity as well as shape of the shockwave front originally projected thereinto from a booster.

Each type of explosive material has a characteristic optimum detonating wave front velocity at which that explosive material decomposes in an ideal manner. At this detonating wave front velocity the maximum possible energy is released in explosive form from each portion of the explosive material through which the detonating wave front travels. This optimum velocity is the steady-state velocity for the explosive material involved. In theory, it is the velocity at which a detonating wave front in a particular explosive material constrained in a particular shape will tend to travel in the long run, once detonation has been initiated. Velocities of a detonation wave front that are either greater than or less than the steady-state velocity indicate that less than the full potential explosive energy in the explosive material is being released by the explosion process. In this light, detonation wave front velocity at each point in a charge of exploding material may be taken as an indicator of the quality of the reaction of the chemicals of that material at each specific location therein.

The actual velocity of the detonating wave front in an explosive material can vary dramatically over the course of an explosion. This is particularly true in the region of the explosive material close to the booster that has initiated the explosion. If the velocity of the detonating wave front initiated in the explosive material by the booster is less than the steady-state velocity, the explosion is termed an under-driven detonation. Typically, the velocity of the detonating wave front in an under-driven detonation will gradually rise toward the steady-state velocity as the detonating wave front propagates through the explosive material and the chemical reactions therein drive the rate of reaction and the velocity of the detonating wave front toward an optimum state of product decomposition at the steady-state velocity.

Detonations in which the velocity of the detonating wave front in the explosive material close to the booster is greater than the steady-state velocity for that explosive material, are called over-driven detonations. In these, the velocity of the detonating wave front will diminish, approaching the steady-state velocity as the detonating wave front travels through the explosive material away from the booster. Occasionally this drop in velocity is so abrupt that the velocity of the detonation wave front falls below the steady-state velocity. Gradually, the detonation wave front velocity will thereafter rise until the steady-state velocity is once again achieved. These detonations will generally be considered to under-driven explosions.

In an under-driven detonation, the distance from the interface surface or top of the booster at which the velocity of the detonation wave front reaches the steady-state velocity is termed the run-up distance for that detonation. An efficient detonation requires that the steady-state velocity be achieved as promptly as possible. In terms of the efficient consumption of explosive material, detonating wave front velocities of the under-driven variety of detonation represent a loss of potential explosive power. Accordingly, for the designer of an efficient detonation, the minimizing of the run-up distance is an important objective.

In an over-driven detonation, the distance from the interface surface or top of the booster at which the velocity of the detonation wave front slows to and assumes the steady-state velocity is termed the transient velocity distance. Minimizing the transient velocity distance is not necessarily an objective of the designer of an efficient detonation, as enhanced shattering action in the immediate area of the booster is achieved in over-driven detonations. This in turn may render more effective the explosive pressure developed in subsequent stages of the explosion.

Accordingly, the overall efficiency of an explosion can be evaluated in terms of whether the detonation is under-driven or over-driven, the time following booster detonation at which steady-state velocity is achieved, and the degree to which that velocity is maintained throughout the balance of the explosion thereafter. These parameters of an explosive detonation will be illustrated through the use of the graphs of FIGS. 3A, 3B, and 3C and 4A and 4B, which contain velocity traces for explosions detonated by the various cylindrical boosters shown in FIGS. 2A, 2B, and 2C and already discussed.

FIGS. 3A, 3B, and 3C are examples of velocity traces resulting from the use of various sizes of nitroglycerine boosters of the traditional elongated cylindrical shape, such as booster 30 of FIG. 2A, in a six-inch diameter borehole to detonate a charge of ANFO. ANFO has a steady-state velocity under those conditions of approximately 12,000 feet per second. All of the detonations illustrated in FIGS. 3A, 3B, and 3C were under-driven.

FIG. 3A illustrates the velocity trace of a 1.25 pound booster, such as booster 30 of FIG. 2A, having a height of eight inches and a circular diameter of two inches. The detonation wave front velocity in the vicinity of the interface surface at the top of the booster can be seen to have been substantially less than the steady-state velocity for the material being detonated. For the portion of the velocity trace shown in FIG. 3A, the detonation wave front velocity never did in fact reach the steady-state velocity for ANFO under the conditions present. Under most circumstances, this would suggest that a booster had been used which was not adequately large in relation to the energy level of its constituent material for the size of borehole and type of explosive material detonated.

FIG. 3B illustrates the velocity trace produced by a larger 2.75 pound booster, such as booster 30 of FIG. 2A, having a height of eight inches and a circular diameter of three inches. As in FIG. 3A, the detonation illustrated in FIG. 3B was under-driven. Nevertheless, the resulting velocity trace reveals that the detonation wave front velocity increased rapidly enough that it eventually reached the steady-state velocity at a run-up distance of approximately 21–23 inches. The rapid rise of the detonation wave front velocity illustrated in FIG. 3B would under most circumstances be taken as an indication that the detonation illustrated was more efficient than that of FIG. 3A.

FIG. 3C shows the velocity trace resulting from the use of yet a larger six pound booster, such as booster 30 of FIG. 2A, which was six inches in diameter and five inches in height. The additional energy provided by the larger booster is seen to have resulted in a shortened run-up distance and in enhanced detonation wave front velocities, even where these were less than the steady-state velocity for ANFO under the conditions present. In the case illustrated in FIG. 3C, the diameter of the booster employed was substantially equal to the diameter of the borehole in which it was detonated. Prior to the present invention, conventional wisdom was to the effect that such was the optimum desirable relationship between booster diameter and borehole diameter, if maximally efficient detonation were an objective. FIGS. 4A and 4B are examples of velocity traces of various other cylindrically shaped boosters, such as the low-profile booster 50 of FIG. 2B and the hybrid booster of FIG. 2C. In each instance,the booster involved was made of Pentolite and used in a ten-inch diameter borehole to detonate a charge of ANFO. ANFO has a steady-state velocity under those conditions of approximately 14,000 feet per second.

FIG. 4A shows the velocity trace for a five-pound low-profile booster, such as booster 50 of FIG. 2A. In the immediate vicinity of the booster, the detonation wave front velocity exceeded the steady-state velocity for the explosive material being detonated. The detonation wave front velocity dropped abruptly, however, and for a substantial distance from the top of the booster was less than the steady-state velocity before it increased to that optimum level. The detonation is thus considered under-driven, and in the case shown in FIG. 4A the run-up distance for the detonation was approximately 24 inches.

A velocity trace for a hybrid booster, such as booster 60, weighing three pounds is shown in FIG. 4B. The detonation that resulted was over-driven, as the detonation wave front velocity did not fall below the steady-state velocity to any substantial degree or for any appreciable period. The transient velocity distance shown of approximately 20 inches would suggest that enhanced shattering action occurred in the immediate area of the booster with corresponding favorable effects on detonation efficiency.

As is readily appreciable from the velocity traces discussed above, the character of the booster used to detonate an explosive material can have a significant impact upon the quality of explosion that results. Enhanced detonation efficiency will predictably result in the need to employ a smaller quantity of explosive material for equivalent results. Thus, while a booster represents but a small percentage of the total cost of preparing for a explosion, manipulation of the type of booster used offers the potential for large increases in the overall efficiency of the detonation at a small change in its total cost. With this objective in mind, research was commenced to determine on a scientific basis the best suited booster for each varying borehole condition. It was known that changing the composition of a booster would affect the nature of the detonation that it produced. Apart then from this variable, the object was to maximize the release of energy in the blasting agent employed by manipulating the size, shape, and orientation of the booster employed to initiate its detonation.

Prior to the present invention no single booster had been devised which resulted in minimal weight, optimal detonation efficiency, unlimited functionality due to the capacity to employ blasting caps, and reasonably acceptable manufacturing costs.

SUMMARY OF THE INVENTION

Overview

The broad learnings acquired in the search for a maximally efficient booster will be set forth below.

It was initially concluded that the initiating efficiency of a booster is related in a direct way to its diameter. Increasing diameter did not, however, necessarily require an increase in booster mass, unless one remained a prisoner to the traditional elongated cylindrical booster shape dictated by borehole geometry. In particular, it was discovered that, rather than increasing the diameter of a booster along its entire length, enlarging the interface surface of the booster only would result in an increase in the efficiency of the detonation.

Surprisingly, a reduction in the mass or volume of a booster backing its interface surface did not necessarily decrease blast initiation efficiency in relation to a heavier booster with an identical interface surface. In fact, a reduction of booster mass or volume in this fashion served in numerous instances to actually enhance the effectiveness of the overall detonation. Finally, optimum booster performance appeared to result when the interface surface thereof was relatively planar and was directed toward the explosive to be detonated.

The insight derived collectively from these observations is supportive of a model of the detonation process in which efficiency is understood to be at least partially a function of the shape of the detonating wave front as it passes through an explosive material. In particular, the less curvature exhibited by the detonating wave front, the more efficient the detonation. In a columnar charge of explosive material, the planar detonating wave front should be oriented normal the longitudinal axis of the columnar charge and should travel parallel thereto in order to achieve the maximum efficiency attainable.

Objects of the Invention

One object of the present invention is to produce an improved booster and method of using such which results in more efficient detonation of a charge of explosive material, thereby reducing the cost associated with creating a given explosive effect. The achievement of this object of the present invention contemplates a reduction in the amount of explosive material required or a reduction in the number of the boreholes drilled in a given borehole array.

Another object of the invention is to provide such an improved booster without increasing the amount of the material required for its fabrication.

Still another object of the present invention is to reduce the material required to fabricate explosive boosters, while maintaining or increasing the detonation efficiency provided by such boosters. The achievement of this object of the present invention contemplates a reduction in the cost and effort associated with booster transport and handling.

It is an object of the present invention to provide such an improved explosive booster as can be used with a blasting cap and thus possesses unrestricted utility.

Yet another object of the present invention is to provide a method and apparatus capable of producing a substantially planar detonating wave front in a charge of explosive material in order to effect maximally efficiency detonation thereof.

A final object of the present invention is to produce an explosive booster as described above which is easy and inexpensive to manufacture.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

Summary

To achieve the foregoing objects, and in accordance with the invention as embodied and broadly described herein, a booster is provided in one embodiment of the present invention comprising a substantially flat interface surface, at one end thereof and a body portion terminating at the interface surface in a base substantially congruent thereto. The body portion is configured such that the area of the cross-section of the body portion in at least one first plane parallel the plane of the interface surface is less than the area of the interface surface. The area of the cross-section of the body portion in any second plane located between the interface surface and the first plane and oriented parallel any such first plane is less than or equal to the area of the interface surface. On the other hand, in any third plane located on the side of the second plane remote from the interface surface and oriented parallel to the first plane; the area of the body portion in the third plane is less than or equal to the area of the cross-section of the body portion in the first plane.

A presently preferred shape for the body portion is that of a frustum of a cone with the base of the cone substantially coinciding with the interface surface.

In another aspect of the present invention, an explosive booster is provided comprising a body portion having tapered sides and an interface surface at the larger end of the body portion disposed generally laterally thereof for contacting an explosive material. Optionally, the body portion may further comprise a plate-shaped interface surface support section and a backing section. The interface surface support section terminates at one side thereof in a base surface substantially coincident with the interface surface. The backing section has tapered sides and is joined at the larger end thereof to the interface support section on the side thereof opposite from the base surface. The area of the cross-section of the backing section at the larger end thereof is preferably less than or equal to the area of the cross-section of the interface support section at the side thereof opposite from the base surface.

The booster of the present invention further comprises at least one passageway, but preferably a plurality of passageways, formed in the body portion for receiving in operable engagement therewith a means for detonating the booster. Preferably one passageway is a dead-end receptacle for a blasting cap.

In an alternative aspect of the present invention, an explosive booster comprising a quantity of selectively detonatable high energy material is formed into a shape terminating in a planar surface at one thereof. The shape is so configured that the area of the cross-section of the shape taken in a plane parallel the planar surface diminishes with the distance of the plane from the planar surface.

According to yet another aspect of the present invention, a device is provided for producing a substantially planar detonating wave front in an explosive material. The device comprises a booster in contact with the explosive material and means operably engaging the booster for detonating the booster to generate a shockwave front and propagate the shockwave front into the explosive material. The booster of such a device comprises a generally tapered body portion and a planar interface surface at the larger end of the body portion extending generally laterally thereof for contacting the explosive material.

In still another aspect of the present invention, a method is provided for increasing the detonation efficiency of a given quantity of high energy explosive material in relation to an explosive material. The method comprises the steps of casting or forming the quantity of high energy explosive material into a booster comprising a planar interface surface at one end thereof for contacting the explosive material, a body portion terminating in a base surface substantially coincident with the interface surface, and at least one passageway formed in the body portion of the booster for receiving in operative engagement therewith a means for detonating the booster. The body portion of the booster is so configured that the area of the cross-section of the body portion in any first plane parallel the plane of the interface surface is less than or equal to the area of the interface surface and less than or equal to the area of the cross-section of the body portion in any second plane between the first plane and the interface surface and parallel thereto. Thereafter, in the method of the present invention, a means for detonating is installed in one of the passageways in the body portion of the booster in operable engagement therewith. The booster and the means for detonating operably engaged therewith are located in contact with the explosive material at one end thereof with the planar interface surface of the booster oriented toward the body of the explosive material. Finally, in the method of the present invention, the means for detonating is activated to explode the booster, generating a detonating wave front and propagating the detonating wave front through the explosive material using a relatively short run-up distance to the steady-state velocity.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through use of the following drawings in which.

DESCRIPTION OF THE PREFERRED EMBODIMENT

Figure 5:
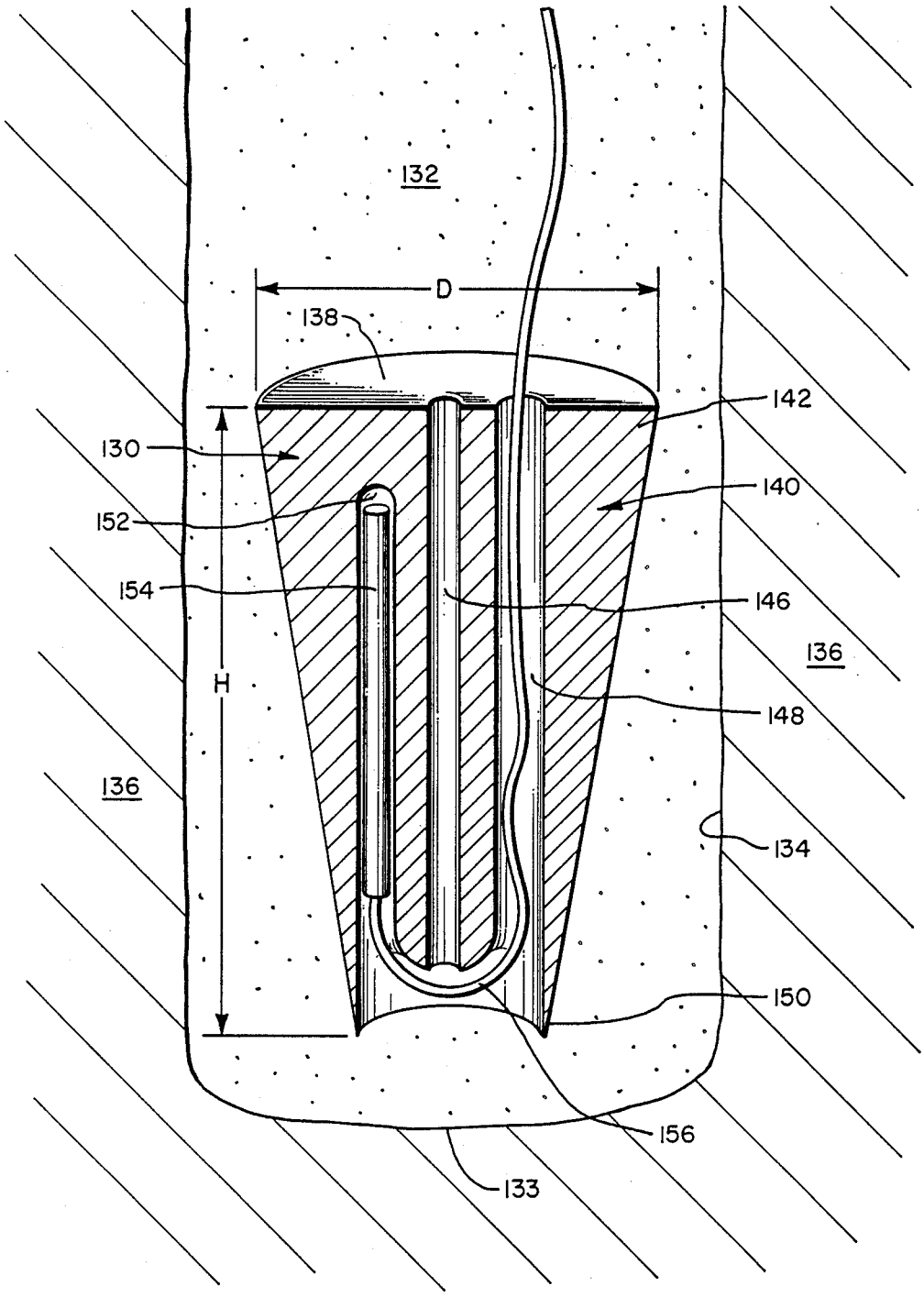
FIG. 5 is a cross-sectional perspective view of a preferred embodiment of an explosive booster shaped according to the teachings of the present invention for high efficiency detonating and arranged with other elements for detonating an explosion.

FIG. 5 depicts a presently preferred embodiment 130 of a booster incorporating all the teachings of the present invention installed ready for detonation below an explosive material 132 at the bottom 133 of a borehole 134 in a rock formation 136. Preferred embodiment 130 includes a flat interface surface 138 directed toward and in contact with the main body of the charge of explosive material 132. It is inherent and acceptable with a booster, such as preferred embodiment 130 installed in the manner shown in FIG. 5, that a small quantity of the explosive material 132 will sift into the space in borehole 134 below interface surface 138 on either side of the booster.

Preferred embodiment 130 includes a body portion 140 in the shape of a frustum of a cone. The larger end 142 or base of body portion 140 substantially coincides with interface surface 138. Formed in body portion 140 traversing the full height H thereof, are longitudinally disposed passageways 146, 148, that communicate between interface surface 138 and small end 150 of preferred embodiment 130 remote therefrom. The height H of preferred embodiment 130 is such that a dead-end passageway 152 may be formed in body portion 140 parallel to passageways 146, 148.

Body portion 140 of preferred embodiment 130 may advantageously be formed of a cast primer material, such as Pentolite, Composition B, an octol, H6, or other synthetic cast materials. Materials other than Pentolite require the addition of an internal sensitizer if used in this role. In addition, boosters according to the present invention can be made from nitroglycerine compositions, torpex, emulsion explosives, and slurrified blasting-cap-sensitive high explosives. Other compositions such as Nitroparaffin will also perform satisfactorily.

For best results, preferred embodiment 130 should be installed with the larger planar surface thereof directed toward and in contact with an explosive material 132 in the manner shown in FIG. 5. A blasting cap 154 is installed in dead-end passageway 152 and connected by a cord 156 through passageway 148 to a remote detonation control device (not shown). When thus installed, preferred embodiment 130 and blasting cap 154, or other suitable means for detonating a booster, comprise a device for producing a substantially planar detonating wave front in the explosive material 132.

Figure 6A:
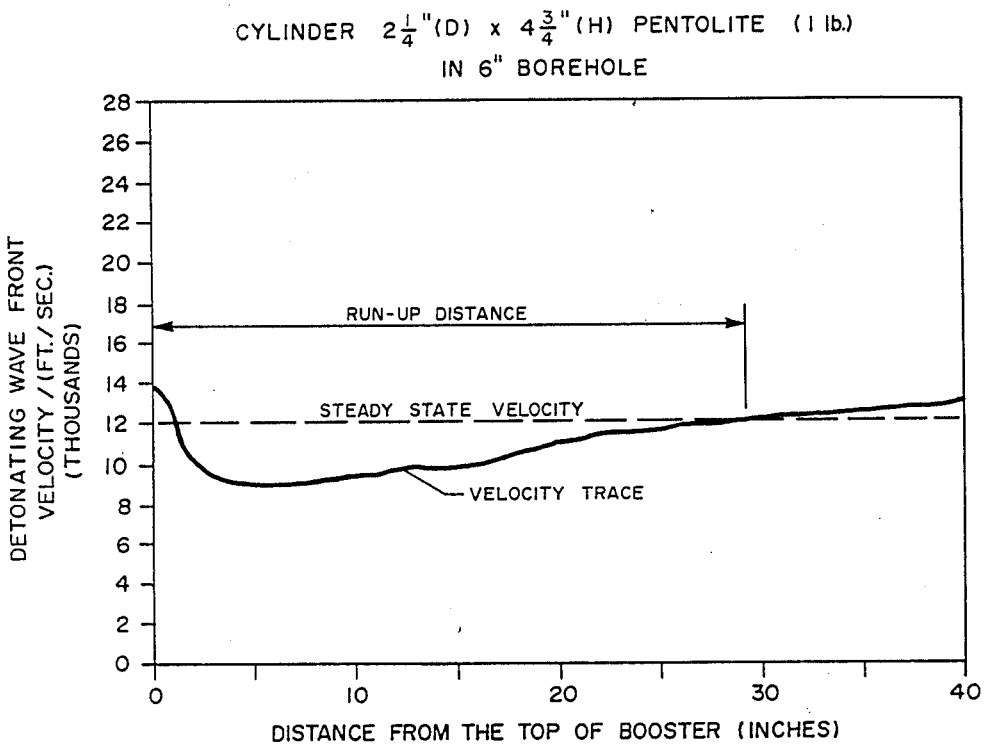
FIG. 6A is a velocity trace produced in an explosion detonated by an explosive booster such as that shown in FIG. 2A.
Figure 6B:
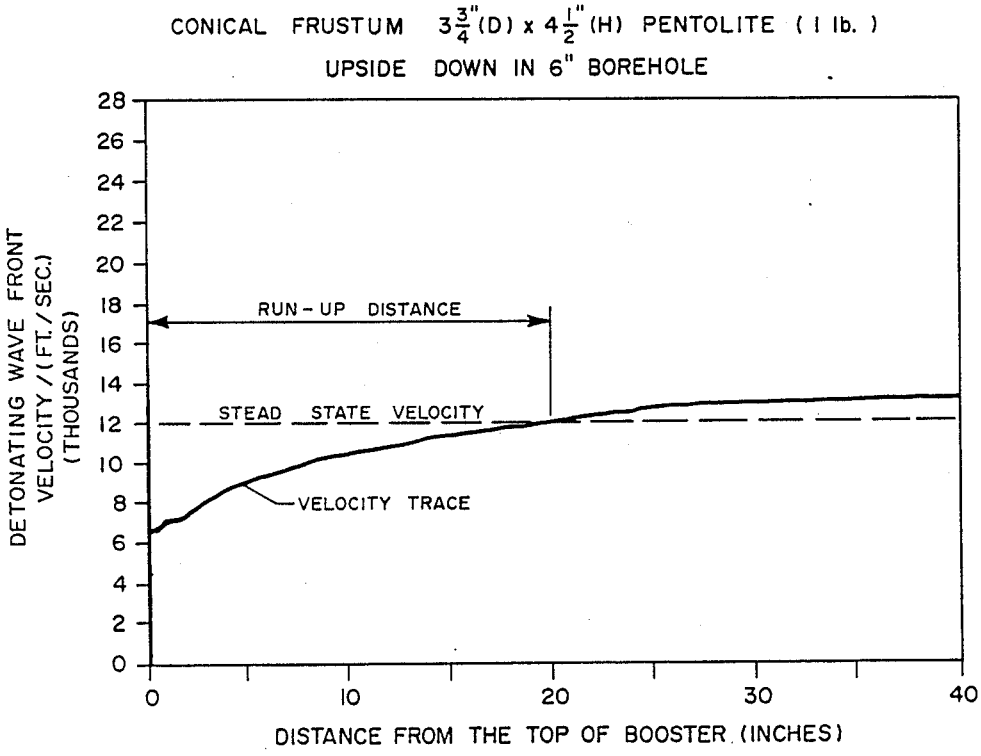
FIG. 6B is a second velocity trace produced in an explosion detonated under the conditions prevailing in FIG. 6A by the inventive explosive booster of FIG. 5 oriented in a less than optimal manner relative a charge of explosives.
Figure 6C:
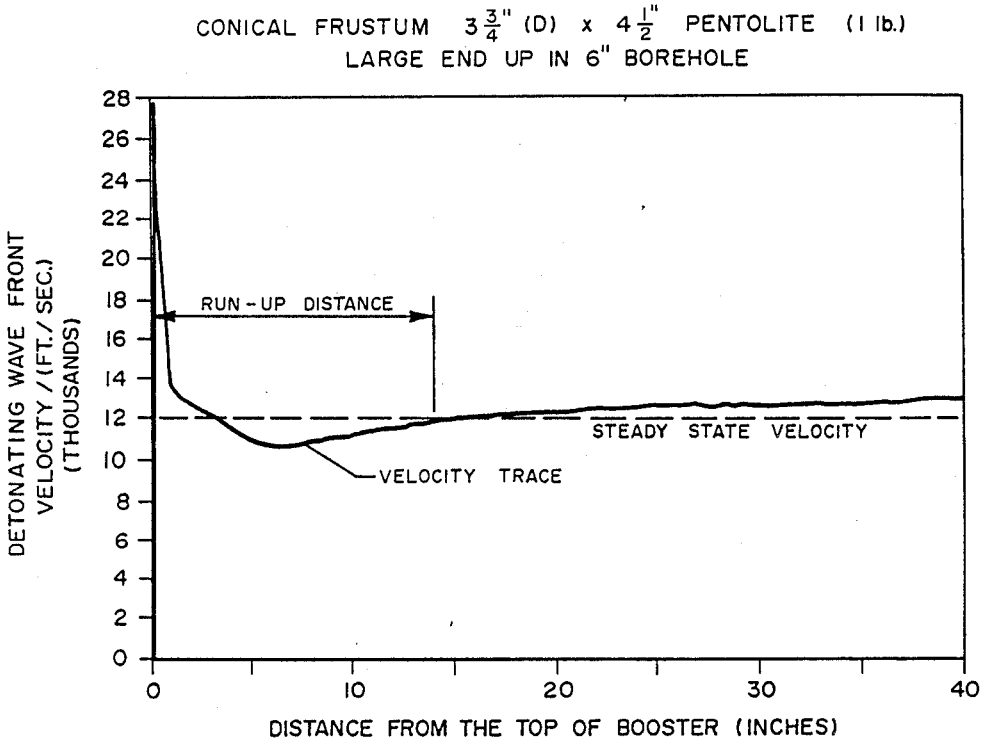
FIG. 6C is a third velocity trace produced in an explosion detonated under the conditions prevailing in FIG. 6A by the inventive explosive booster of FIG. 5 oriented in a preferred manner relative a charge of explosives.

The effectiveness of a booster, such as preferred embodiment 130, in increasing the detonation efficiency of an explosive material can be appreciated first by reference to the velocity traces for detonations shown in FIGS. 6A–6C. All of these velocity traces were generated by detonating a charge of ANFO in a six inch diameter borehole using one-pound Pentolite explosive boosters. Under such conditions ANFO has a steady-state velocity of approximately 12,000 feet per second. The three distinct velocity traces shown were obtained merely by altering the shape or orientation of the booster with which the detonation was initiated. The mass of high explosive booster material was a constant.

Figure 1:
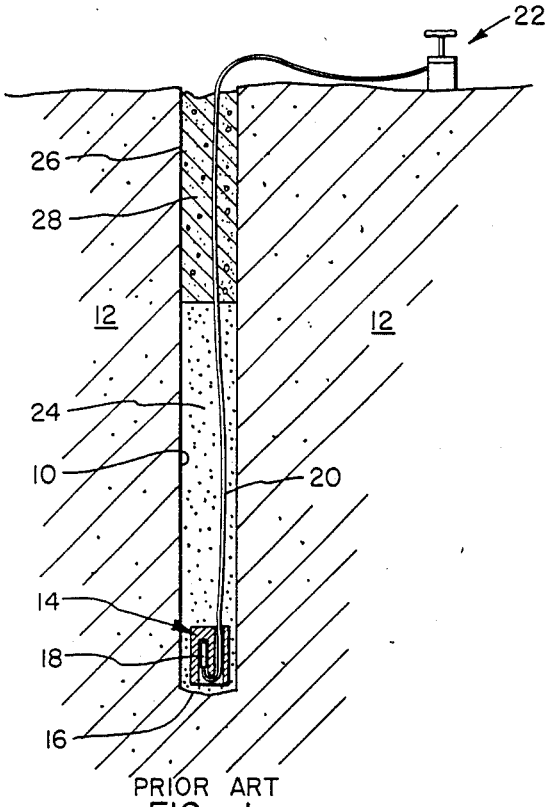
PRIOR ART FIG. 1
FIG. 1 is a cross-sectional diagram of a borehole for explosives illustrating a typical arrangement of the components used to detonate an explosion therein.
Figure 2A:
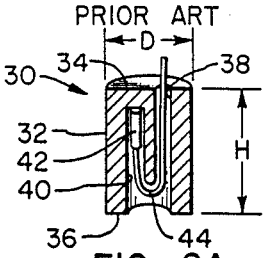
FIG. 2A is a cross-sectional perspective view of one example of a known explosive booster.

FIG. 6A shows a velocity trace resulting from the detonation of a traditionally shaped cylindrical booster, such as booster 30 of FIG. 2A, having a diameter of 2.25 inches and a height of 4.75 inches. After a short initial period of high velocity, the detonation wave front velocity fell below the steady-state velocity, only to regain that velocity at a run-up distance of approximately 28–30 inches. The detonation is thus considered to have been under-driven.

Using an explosive booster having the same weight as that used in relation to FIG. 6A, but configured in the shape of a conical frustum, such as is typified by preferred embodiment 130 in FIG. 5, the results depicted in FIGS. 6B and 6C were obtained. The one-pound booster employed in both of the latter instances had a height of 4.50 inches and a diameter at the larger circular end surface of 3.75 inches and a volume that is about 38 percent of the volume of a traditional cylindrical booster having a height of 4.50 inches and a base with a diameter of 3.75 inches. Thus, by shaping a booster according to the teachings of the present invention, it should first be appreciated that a given quantity of high-explosive booster material can be formed into an explosive booster of diameter enhanced when compared to traditional cylindrical shapes.

The velocity trace in FIG. 6B was produced when such an inventive booster was detonated with the larger planar surface thereof oriented downward, rather than toward the main charge of explosive. A run-up distance of approximately 20–22 inches resulted. Nevertheless, while begun as an over-driven detonation, the detonation wave front velocity of the detonation depicted in FIG. 6B plummeted far below the steady-state velocity before increasing again to that optimum speed. As a result, despite a shorter run-up distance than resulted in the detonation of FIG. 6A, the detonation of FIG. 6B is considered to have produced a less efficient explosion than that associated with FIG. 6A.

The velocity trace shown in FIG. 6C is one that resulted from a booster shaped as a conical frustum, such as preferred embodiment 130 of FIG. 5, and having the same dimensions as that used in FIG. 6B, but oriented so that the large planar surface thereof, the interface surface of the booster, was directed toward the main charge of explosive material. A run-up distance of a mere 10–12 inches resulted. The velocity trace in FIG. 6C thus compares quite favorably with that resulting using a traditional cylindrically shaped booster as in FIG. 6A, or the inverted inventive booster as in FIG. 6B. The results in FIG. 6C when compared with those in FIG. 6B underscore the significance of orienting the large planar surface of an explosive booster according to the present invention toward the explosive material being detonated.

Figure 7A:
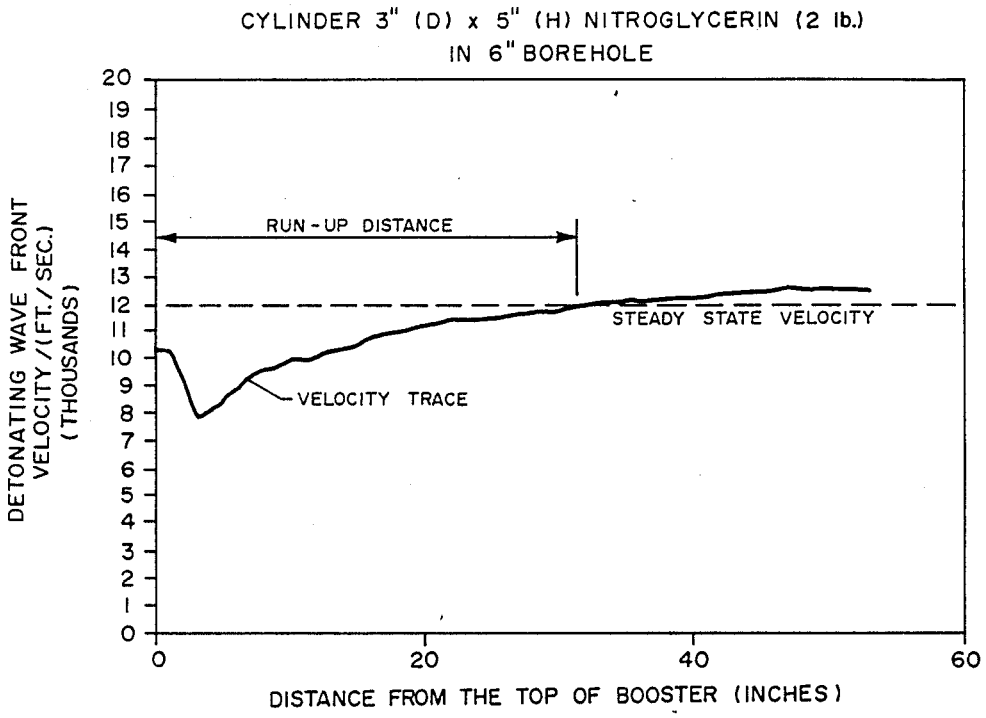
FIG. 7A is a velocity trace produced in an explosion detonated by an explosive booster such as that shown in FIG. 2A.
Figure 7B:
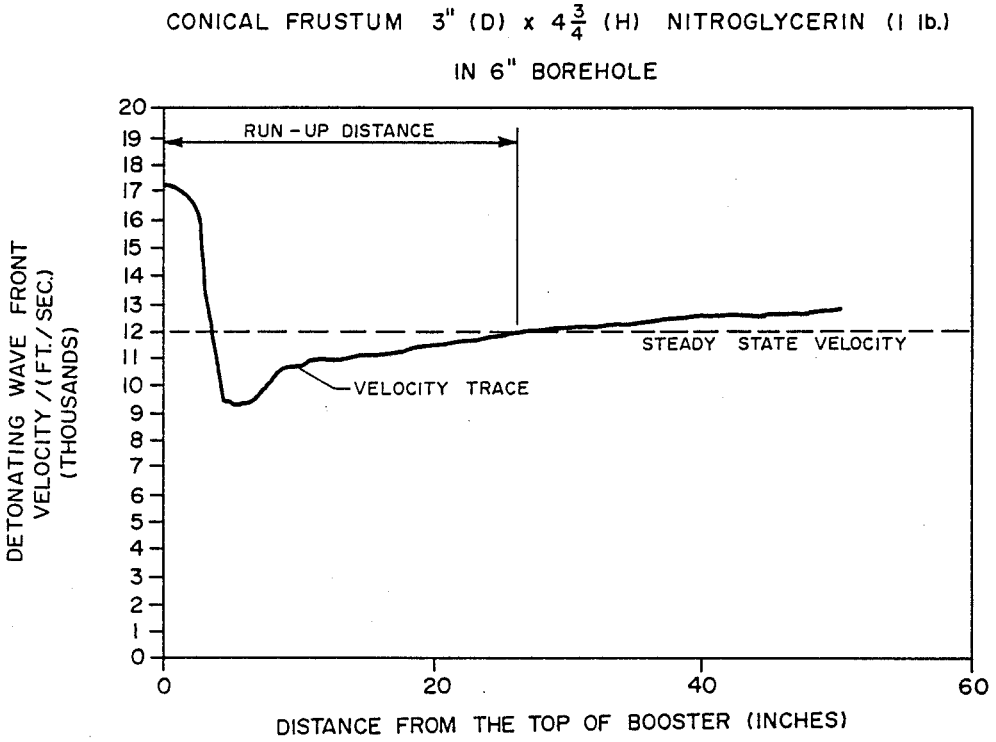
FIG. 7B is a second velocity trace produced in an explosion detonated under the conditions prevailing in FIG. 7A by the inventive explosive booster of FIG. 5.

FIGS. 7A and 7B permit a comparison of detonation efficiency in boosters having identical diameters, as opposed to identical weights. In FIGS. 7A and 7B an explosive charge of ANFO in a six-inch diameter borehole was detonated using three-inch diameter boosters made of a nitroglycerine composition. ANFO under such conditions has a steady-state velocity of approximately 12,000 feet per second. FIG. 7A is a velocity trace produced by a booster of traditional cylindrical shape, such as booster 30 shown in FIG. 2A. The booster involved, which had a circular diameter of three inches and a height of five inches, weighed approximately two pounds. As seen in FIG. 7A, the resulting detonation was under-driven with a run-up distance of approximately 27–30 inches.

On the other hand, however, the velocity trace of FIG. 7B has an improved run-up distance of approximately 22–25 inches. The booster involved in FIG. 7B was one configured according to the teachings of the present invention as a conical frustum, such as preferred embodiment 130 of FIG. 5, having a height of 4.75 inches and a circular diameter at its larger face of three inches. That larger face was oriented toward the explosive material, thus serving as the interface surface of the booster. The frustoconical booster had a volume that was about 53 percent of the volume of a traditional cylindrical booster having a height of 4.75 inches and a base with a 3-inch diameter.

While the boosters used both in FIGS. 7A and 7B had identical circular diameters, that of 7B weighed only one pound, half the weight of the cylindrical booster used in Fig. 7A. Accordingly, the present invention includes a method for increasing the detonation efficiency of a given quantity of high-energy explosive booster material in relation to an explosive material, reducing in many instances the amount and cost of the charge of explosives required for any given explosive effect. Given the vast quantities of such explosives used annually in the mining industry alone, substantial savings can be expected as a result.

The method comprises the steps of casting or forming the quantity of high-energy explosive material into a booster configured according to the teachings of the present invention, such as preferred embodiment 130 shown in FIG. 5. Thereafter a means for detonating the booster, such as blasting cap 154, is installed in operable engagement therewith and both are located in contact with an explosive material, so that the planar interface surface of the booster is in contact with the explosive material and oriented toward the main body thereof. Finally, activating the detonating means to explode the booster generates a detonating wave front and propagates that detonating wave front through the explosive material with a relatively short run-up distance, so as to effect efficient detonation of the explosive material.

The booster and method of the present invention result in more efficient detonation of an explosive material, thereby reducing the cost associated with a given explosive effect. The velocity traces shown in FIGS. 6A–6C demonstrate that a booster configured according to the present invention provides increased booster efficiency without increasing the amount of material required for booster fabrication. The velocity traces of FIGS. 7A and 7B demonstrate further that the method and device of the present invention actually permit a reduction in the amount of material used to fabricate explosive boosters without detracting from detonation efficiency. In fact, detonation efficiency is increased.

The preferred embodiment 130 shown in FIG. 5 and the other embodiments disclosed herein provide a booster having an enlarged diameter or interface surface in combination with a reduction in the mass or volume of highly explosive material backing the interface surface. The combination of these two features of geometric configuration is thought to produce a flatter detonating wave front in the explosive material with which the booster of the present invention is used.

That such advantageous functioning results, regardless of the material of which the booster is constructed, is apparent in the improvement in performance observable both in relation to FIG. 6C over FIG. 6A, which involved boosters made of Pentolite, and in FIG. 7B over FIG. 7A, both using nitroglycerine boosters. Optimum booster performance occurs when the interface surface thereof is substantially flat or planar and is oriented toward, rather than away from, the charge of explosive to be detonated.

More generalized geometric parameters for explosive boosters incorporating the teachings of the present invention will be described below in relation to FIGS. 8, 9A, and 9B.

Figure 8:
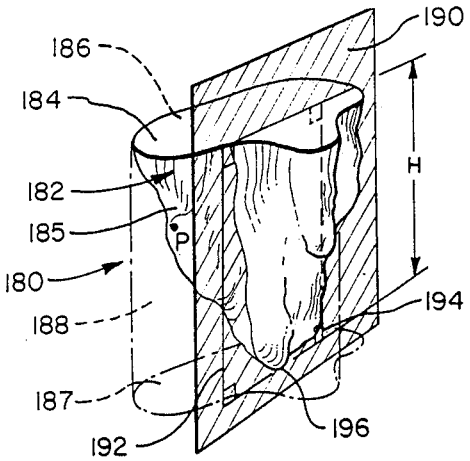
FIG. 8 is a perspective view of a generalized embodiment of an explosive booster according to the present invention shown in relation to a reference solid used to define the geometry of the inventive embodiment.

In FIG. 8, a reference solid 180 is shown overlying an inventive generalized booster embodiment 182. Generalized booster embodiment 182 has a substantially flat interface surface 184 at one end thereof which is intended to contact an explosive material with which generalized booster embodiment 182 is to be used. Generalized booster embodiment 182 includes in addition a body portion 185 which terminates at interface surface 184 in a base substantially congruent thereto. Interface surface 184 defines, and in FIG. 8 is coincident with, the floor 186 of reference solid 180.

Floor 186 is congruent with and parallel to an opposed end surface 187 of reference solid 180. Opposed end surface 187 and floor 186 are located a predetermined distance H apart, oriented such that the sides 188 of reference solid 180 between floor 186 and opposed end surface 187, if intersected by a plane, such as plane 190, which is normal to floor 186, form straight lines, such as lines 192, 194, which are also normal to floor 186. In this manner, reference solid 180 can be seen to have a broadly prismatic geometry with a cross-section in any plane parallel to floor 186 that is congruent to interface surface 184 of generalized booster embodiment 182.

With reference solid 180 overlying generalized booster embodiment 182, as in FIG. 8, the point 196 on the surface of generalized embodiment 182 maximally remote from interface surface 184 lies in opposed end surface 187 of reference solid 180. Body portion 185 of generalized booster embodiment 182 thus has a height measured normal to interface surface 184 which is equal to the predetermined distance H between floor 186 and opposed end surface 187 of reference solid 180.

In a generalized embodiment of an explosive booster incorporating the teachings of the present invention, such as generalized booster embodiment 182, each point P on the surface of body portion 196 is on or interior to reference solid 180, and at least one such point P is interior to reference solid 180. In this manner the volume of body portion 196 of generalized embodiment 182 is less than the volume of reference solid 180. An explosive booster configured in the manner of generalized booster embodiment 182, can in general be expected to possess a detonating efficiency greater than that of an explosive booster in the shape of corresponding reference solid 180.

No representation is made that an irregularly shaped explosive booster, such as generalized booster embodiment 182, would necessarily be easy or inexpensive to manufacture. Nevertheless, such a booster would require less high energy explosive material for its fabrication than would a booster taking the form of reference solid 180. The reduction in the mass backing interface surface 184 as compared with the mass which would back floor 186 in a booster configured as reference solid 180 will increase the performance of the resultant booster. How precisely this result arises in a detonation in a borehole is not entirely clear. It is thought to have some relation to the degree of flatness of the detonating wave front produced in a borehole-shaped column of explosive material by a booster fulfilling the shape parameters described in contrast to that produced by a booster of a prismatic nature having sides that are parallel to the sides of the borehole in which it is detonated.

Figure 9A:
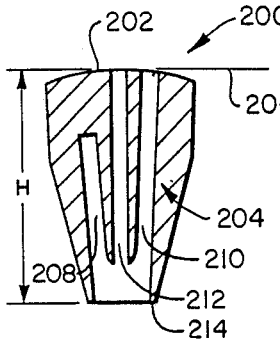
FIG. 9A is a cross-sectional view of a second embodiment of an explosive booster according to the present invention.

The explosive booster of the present invention can be embodied and characterized in an alternative manner in relation to the embodiment of an explosive booster 200 shown in cross-section in FIG. 9A. Booster 200 has an interface surface 202 at one end thereof and a body portion 204 terminating thereat in a base substantially congruent thereto. Interface surface 202 has a slightly convex curvature, indicating that the interface surface of an explosive booster according to the present invention need not be absolutely flat or planar in order that the booster which includes it is within the teachings of the present invention. Some aspects of detonation wave front propagation are degraded by a interface surface which is not flat, a booster with a slightly irregular or curved interface surface, such as interface surface 202. Nevertheless, a booster, such as booster 200, still provides adequate advantages, such as enhanced detonation efficiency and reduced boosted weight, as to be a substantial improvement over known boosters of cylindrical shape and thus within the scope of the present invention.

Accordingly, the inventive explosive booster should be understood to include not merely an absolutely flat interface surface, such as interface surface 184 shown in FIG. 8, but also slightly curved or irregularly shaped concaved or convexed surfaces, one of which is illustrated as interface surface 202 in FIG. 9A. Each such interface surface will have associated therewith a plane which will be referred to herein as the plane of that interface surface. Such a plane, as seen from the edge thereof, is depicted in FIG. 9A as plane 206.

Body portion 204 of booster 200 is configured such that the area of a cross-section of body portion 204 taken in at least one first plane parallel to plane 206 is less than the area of interface surface 202. The area of the cross-section of body portion 206 in any second plane parallel to any such first plane is less than or equal to the area of interface surface 202, if the second plane is located between the first plane and interface surface 202. If the first plane is located between the second plane and interface surface 202, however, the area of the cross-section of body portion 204 in the second plane is less than or equal to the area of the cross-section of body portion 206 in the first plane. A booster shape consistent with these limitations need not necessarily be symmetric as in the case of booster 200.

In the particular example of an inventure booster shown as booster 200 in FIG. 9A, the cross-section of body portion 204 taken in every first plane parallel to plane 206 has an area less than the area of interface surface 202. Furthermore, the area of the cross-section of body portion 204 in any second plane located on the opposite side of any such first plane from interface surface 202 is less than the area of the cross-section of body portion 204 in each such first plane. Thus, the cross-sectional area of booster 200 taken in any plane parallel to plane 206 of interface surface 202 diminishes with the distance of the plane of the cross-section from interface surface 202.

Even these broad descriptions of booster 200 do not fully encompass all devices within the scope of the present invention. Explosive boosters consistent with the teachings of the present invention are possible which would not strictly comport with these descriptions, but which yet would be within the scope of the generalized booster embodiment 182 shown in FIG. 8. Accordingly, booster 200 in FIG. 9A is but a second, albeit relatively general, alternative embodiment of an explosive booster according to the present invention.

As shown in FIG. 9A, booster 200 has a height H substantial enough to permit the formation within body portion 204 of a dead-end receptacle 208 capable of receiving a blasting cap in operable engagement with booster 200. Thus, booster 200 is a high-profile booster. In addition, to facilitate the use of a blasting cap with booster 200, formed within body portion 204 are two longitudinally disposed passageways 210, 212 traversing the full height H of booster 200 between interface surface 202 and opposite end surface 214. The provision of two passageways in addition to dead-end receptacle 208 is entirely optional. Two passageways afford for additional flexibility in the use of boosters, such as booster 200, in that the second passageway through such a booster permits the connecting cord for a blasting cap for another booster lower at a location in the same borehole to be threaded through the higher booster. In this manner several boosters can be located at different levels in a single borehole for simultaneous or sequenced detonation, as desired by the designer of the explosion.

Figure 9B:
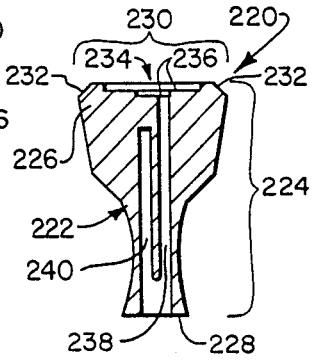
FIG. 9B is a cross-sectional view of a third embodiment of an explosive booster according to the present invention.

The explosive booster of the present invention can be described and further understood in relation to yet another relatively general embodiment of an explosive booster 220 shown in cross-section in FIG. 9B. Booster 220 comprises a body portion 222 having sides 224 and larger and smaller ends 226 and 228, respectively. As can be seen by the profile of sides 224, they are not in any continuous or linear sense tapering at each and every point thereof. In fact, at smaller end 228 of booster 220, sides 224 thereof flare radially outward for a short distance. Nevertheless, the inventive booster includes sides, such as sides 224, that taper in an overall manner from a larger end, such as larger end 226, to a smaller end, such as smaller end 228. While sides, such as sides 224 of booster 220, would not necessarily come within the scope of the description of an explosive booster rendered in relation to booster 200 of FIG. 9A, booster 220 is fully within the teachings of the present invention.

Booster 220 is provided at larger end 226 of body portion 222 with flat interface surface 230 that is disposed generally laterally of body portion 222. Interface surface 230 may be provided with beveled edges 232 or a concave portion 234, which is effected in the embodiment shown in FIG. 9B by discrete recessed steps 236. Concavity in an interface surface, such as interface surface 230, can be effected over either a portion or the entirety of that interface surface using in the alternative smooth, continuous surfaces. Nevertheless, despite beveled edges 232 and concave portion 234, interface surface 230 remains one that is flat or planar for purposes of complying with the teachings of the present invention.

Formed in booster 220 is a plurality of passageways 238, 240 for receiving a means for detonating explosive booster 220. In the embodiment shown, passageway 240 is a dead-end receptacle for a blasting cap. Thus, booster 220 is a high-profile booster.

Figure 2B:
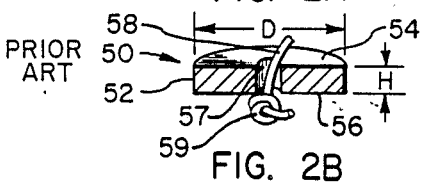
FIG. 2B is a cross-sectional perspective view of a second embodiment of a known explosive booster.
Figure 2C:
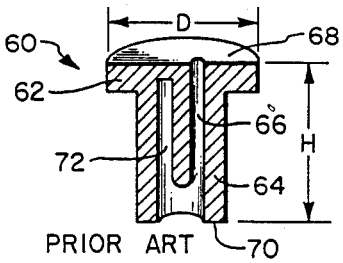
FIG. 2C is a cross-sectional perspective view of a third embodiment of a known explosive booster.
Figure 3A:
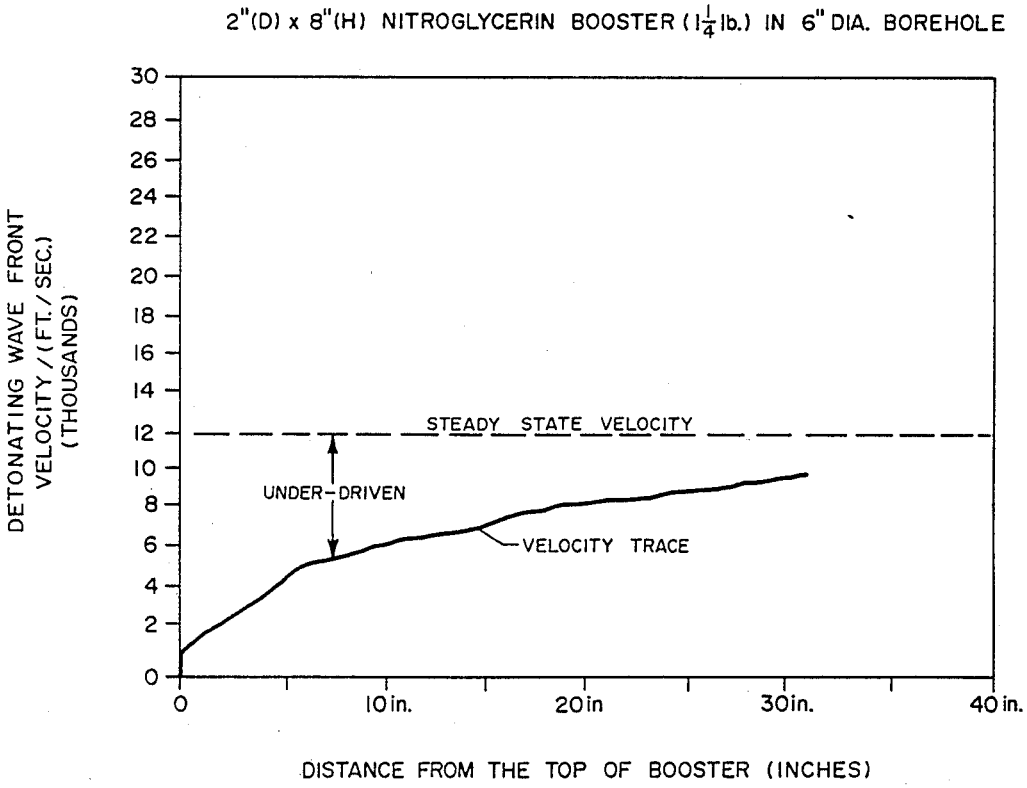
FIG. 3A is a velocity trace produced in an explosion detonated by an explosive booster such as that shown in FIG. 2A.
Figure 3B:
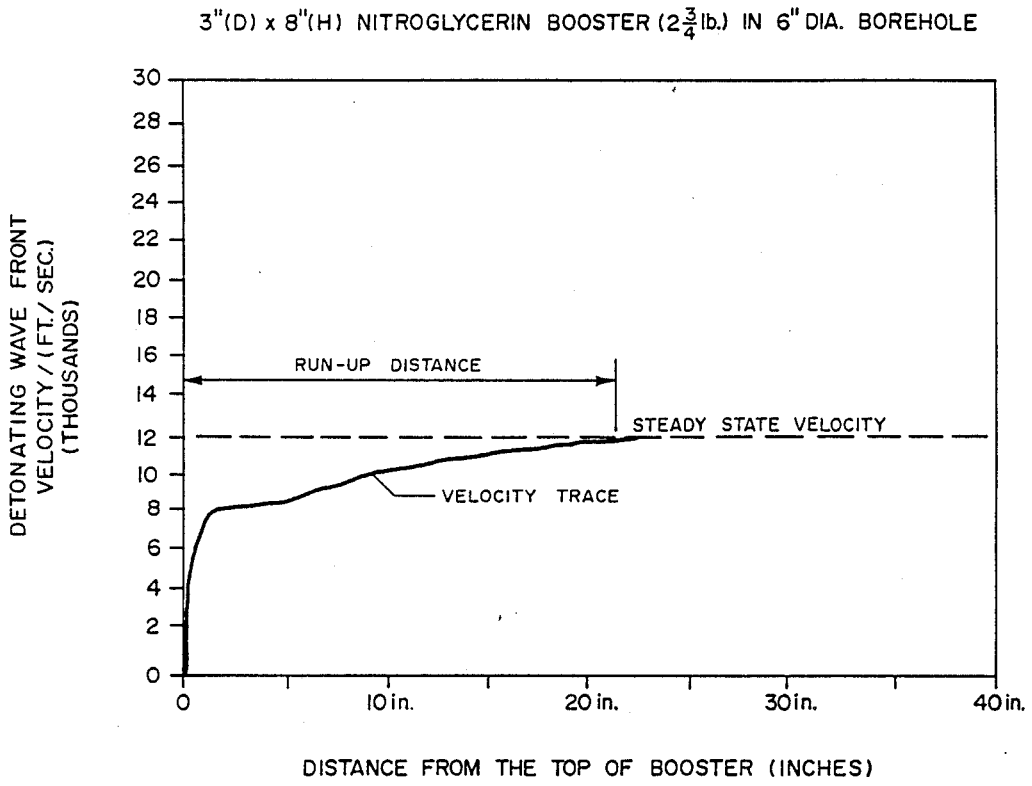
FIG. 3B is a second velocity trace produced in an explosion detonated by an explosive booster such as that shown in FIG. 2A.
Figure 3C:
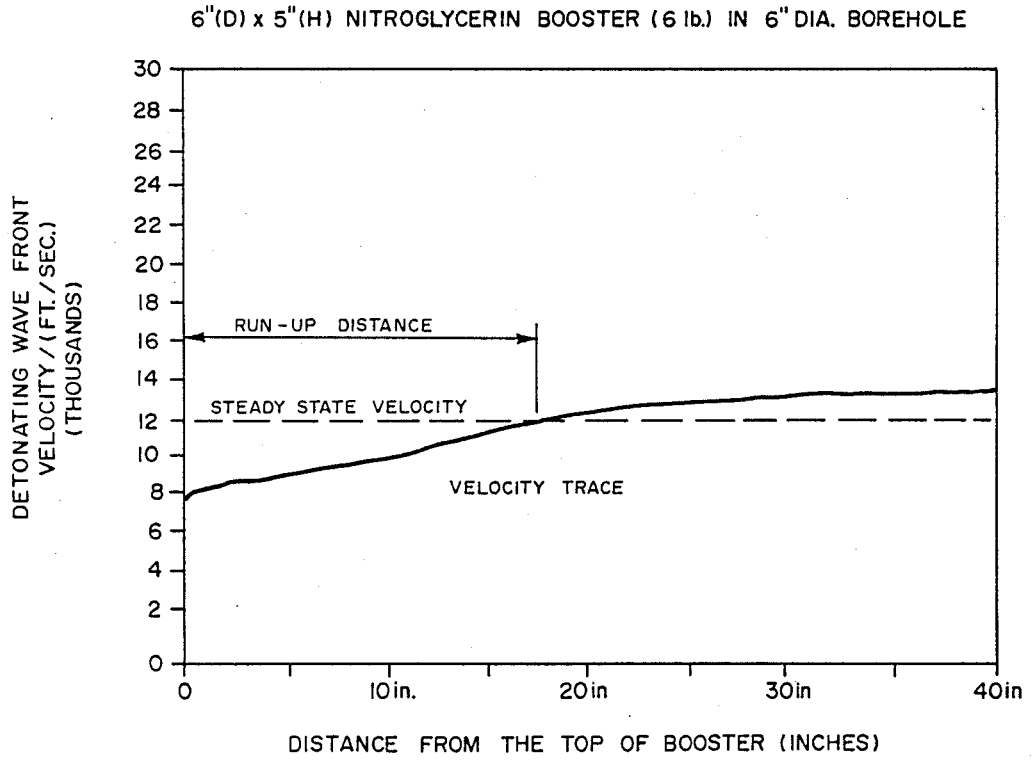
FIG. 3C is a third velocity trace produced in an explosion detonated by an explosive booster such as that shown in FIG. 2A.
Figure 4A:
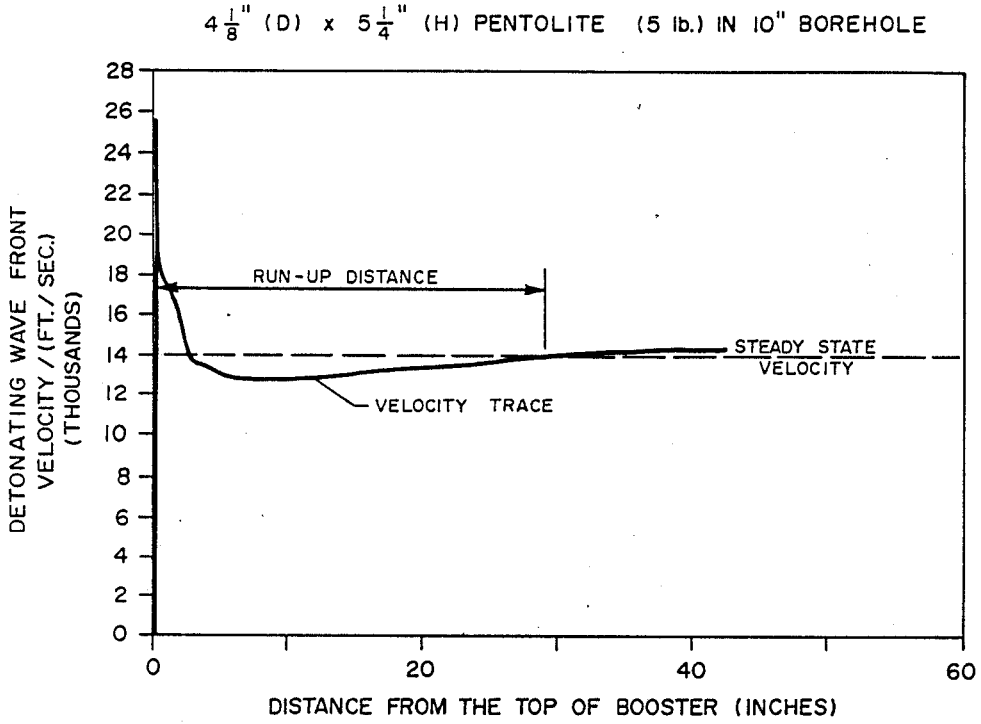
FIG. 4A is a velocity trace produced in an explosion detonated by an explosive booster such as that shown in FIG. 2B.
Figure 4B:
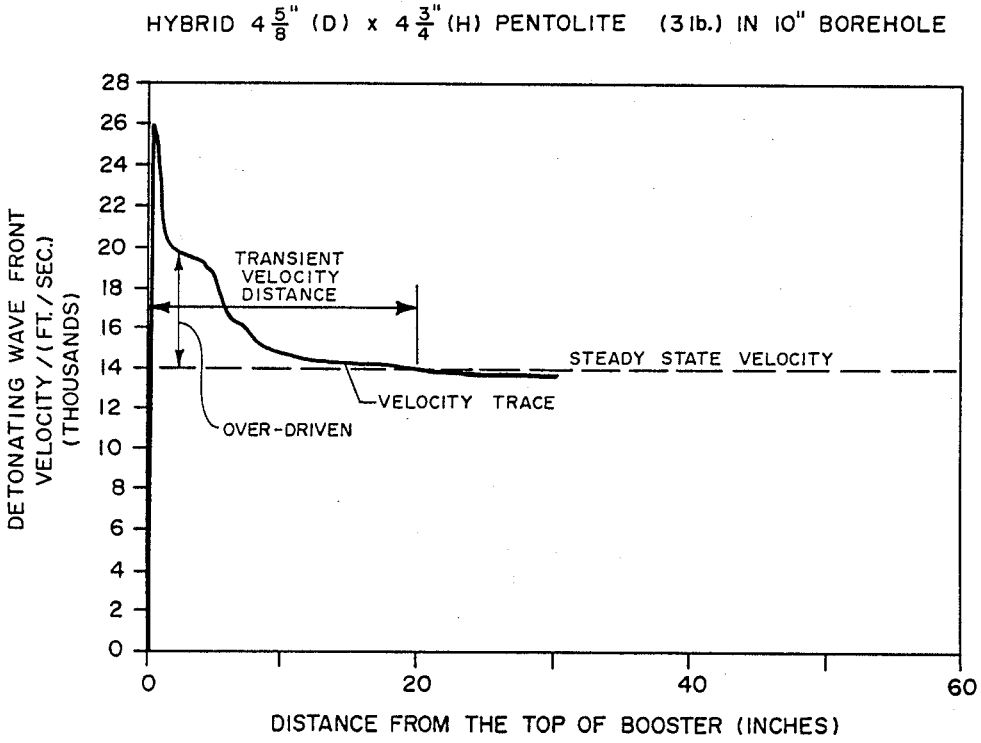
FIG. 4B is a velocity trace produced in an explosion detonated by an explosive booster such as that shown in FIG. 2C.

FIGS. 10A–10H depict various specific shapes of embodiments of explosive boosters considered to be typical of boosters within the scope of the teachings of the present invention. In each of these figures and in the remaining figures throughout this disclosure, the depiction of passageways, such as passageways 238, 240 of FIG. 9B has been eliminated for the sake of simplicity. Comments rendered earlier in relation to FIGS. 2A and 2B, regarding the minimum height H required in a booster if it is to contain a dead-end receptacle for a blasting cap, apply with equal validity to the possibility of including such a dead-end receptacle in a booster embodying the present invention. It must be emphasized, however, that the presence of a dead-end receptacle in an explosive booster is not a requirement of the present invention. It is entirely conceivable that circumstances may be advantageous for the manufacture and use of low-profile boosters which nevertheless incorporate the teachings of the present invention. As a group, the boosters depicted in FIG. 10A–10H, unlike the generalized booster embodiment 182 in FIG. 8, are rotationally symmetric, although such a feature is also not a limitation of the teachings of the present invention.

Figure 10A:
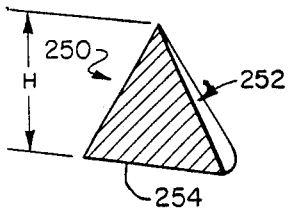
FIGS. 10A–10H are cross-sectional perspective views of various rotationally symmetric alternative embodiments of explosive boosters incorporating the teachings of the present invention.

FIG. 10A depicts a booster 250 incorporating teachings of the present invention having a body portion 252 in the form of a cone. The base 254 of conical body portion 252 substantially coincides with the interface surface of booster 250. It will be appreciated that the configuration of booster 250 advantageously presents an interface surface of enlarged area, while substantially reducing the amount of booster material required for fabrication of booster 250 in comparison with that need for a traditional cylindrical booster having an identical interface surface and height H.

Figure 10B:
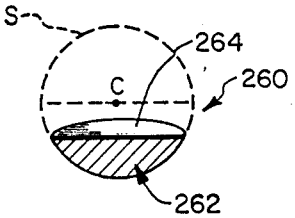

FIG. 10B depicts a booster 260 incorporating teachings of the present invention which could be configured as a low-profile booster for use exclusively with detonating cords. Booster 260 has a body portion 262 that is a spherical segment smaller than a hemisphere separated from a sphere S having a center C by a single plane. The interface surface 264 of booster 260 substantially coincides with the single planar surface of the spherical segment.

Figure 10C:
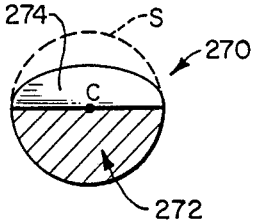

FIG. 10C depicts a booster 270 incorporating teachings of the present invention and having a body portion 272 which is a hemisphere of a sphere S having a center C. Booster 270 has a circular interface surface 274 which substantially coincides with the planar surface of the hemisphere. An explosive booster shaped as booster 270 is a particularly compact form of a booster incorporating the teachings of the present invention.

Figure 10D:
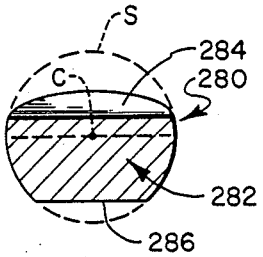

FIG. 10D illustrates a booster 280 incorporating teachings of the present invention and having a body portion 282 which is a frustum of a spherical segment of a sphere S having a center C. The frustum of which body portion 282 is comprised includes larger and smaller substantially planar faces 284 and 286, respectively. Although faces 284 and 286 as shown in FIG. 10D are substantially parallel, this is not a feature required by the teachings of the present invention. Larger planar face 284 is on the opposite side of center C from smaller planar face 286 and serves as the interface surface for booster 280. Larger planar face 284 is accordingly somewhat smaller in area than the area of a cross-section of body portion 282 taken in a plane parallel larger planar face 284 and passing through center C. Nevertheless, as with the case of beveled edges 232 shown in FIG. 9B, minor radial narrowings of the sides of a booster in the vicinity of the interface surface thereof are not considered to detract from the teachings of the present invention generally, although such structure may result in some degradation of the detonation wave front propagated by a booster having such features.

Figure 10E:
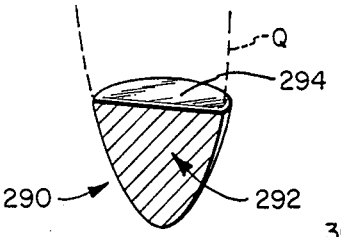

FIG. 10E is a booster 290 incorporating teachings of the present invention and having a body portion 292 that is a parabolic solid generated in relation to parabolic curve Q. The base of body portion 292 coincides with interface surface 294 of booster 290.

Figure 10F:
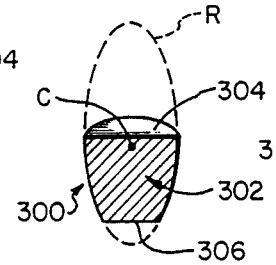

FIG. 10F illustrates yet another booster 300 incorporating teachings of the present invention. Booster 300 has a body portion 302 which is an elliptical solid generated in relation to an elliptical curve R of center C located midway between the focii (not shown) of elliptical curve R. Body portion 302 is further a frustum of such an elliptical solid and includes larger and smaller substantially planar faces 304 and 306, respectively. Although faces 304 and 306 as shown in FIG. 10F are substantially parallel, this is not a feature required by the teachings of the present invention. Larger planar face 304, which substantially coincides with the interface surface for booster 300, is on the opposite side of center C from smaller planar face 306, although such a relative relationship is also not required by the teachings of the present invention.

Larger planar face 304 is somewhat smaller in area than the area of a cross-section of body portion 302 taken in a plane parallel larger planar face 304 and passing through center C. Nevertheless, the radial narrowings of the sides 308 of booster 300 in the vicinity of the interface surface thereof do not detract from the teachings of the present invention generally, although such structure may result in some degradation of the donation wavefront propagated by a booster having such features.

Figure 10G:
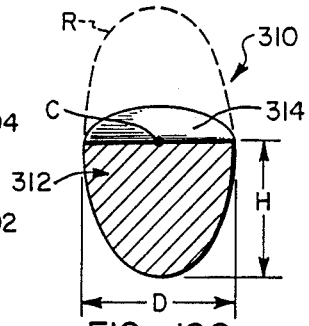

FIG. 10G depicts a booster 310 incorporating teachings of the present invention and having a body portion 312 which is a hemiellipsoid of an elliptical curve R having a center C located midway between the focii (not shown) of elliptical curve R. Booster 310 has a circular interface surface 314 which substantially coincides with the planar surface of the hemiellipsoid. An explosive booster shaped as booster 310 will have a height H greater than the diameter D of interface surface 314 and will accordingly be of greater height and mass than, for example, a hemispherically shaped booster, such as booster 270 of FIG. 10C, having a similarly sized interface surface.

Figure 10H:
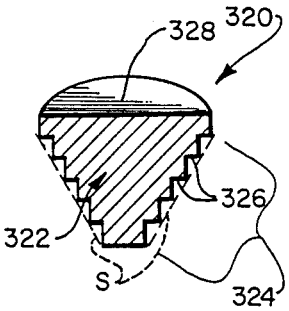

FIG. 10H is an example of a rotationally symmetric booster 320 incorporating the teachings of the present invention and having a body portion 322 with sides 324 comprised of a plurality of discrete discontinuous steps 326. Steps 326, by way of illustration in FIG. 10H fall within an envelope S resembling a frustum of a cone. The interface surface 328 of booster 320 is located at the larger end thereof.

FIGS. 11A–11F depict various specific shapes of embodiments of explosive boosters that are rotationally asymmetric, but are yet considered to be typical of rotationally asymmetric boosters within the scope of the teachings of the present invention.

Figure 11A:
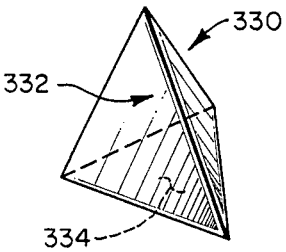
FIGS. 11A–11F are perspective views of various rotationally asymmetric alternative embodiments of explosive boosters incorporating the teachings of the present invention.

FIG. 11A depicts one embodiment of a booster 330 according to the present invention having a body portion 332 in the shape of a pyramid having three faces. The interface surface 334 of booster 330 substantially coincides with the triangular base of the pyramid.

Figure 11B:
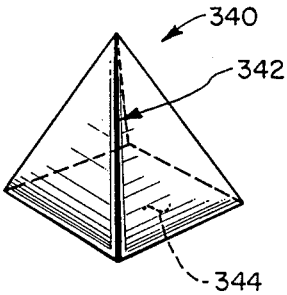

Similarly, FIG. 11B shows a booster 340 according to the present invention having a body portion 342 in the shape of a tetrahedron. The interface surface 344 of booster 340 substantially coincides with the four-sided base of the tetrahedron.

Figure 11C:
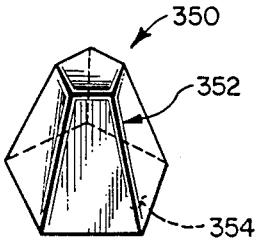

Yet another embodiment of a booster 350 according to the present invention is shown in FIG. 11C. Booster 350 has a body portion 352 which is a frustum of a pyramid. By way of example and not limitation, the pyramid of which body portion 352 is formed as five sides, although a frustum of a pyramid having additional or fewer numbers of sides is considered to be within the scope of the embodiment disclosed. The interface surface 354 of booster 340 substantially coincides with the five-sided base of the frustum.

Figure 11D:
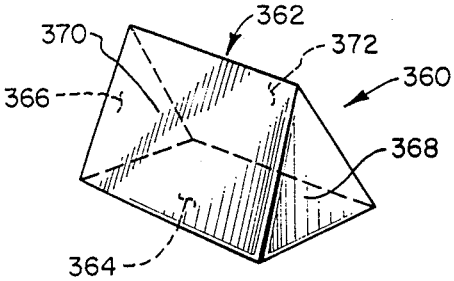

FIG. 11D illustrates a booster 360 according to the teachings of the present invention having a body portion 362 that is a triangular prism. Interface surface 364 of booster 360 substantially coincides with the base of the prism. End faces 366, 368 of body portion 362 as shown in FIG. 11D are substantially normal to interface surface 364. Nevertheless, the effect of inclined faces 370, 732 of body portion 362 on the volume of booster 360 backing interface surface 364 nevertheless produces a generally tapered shape in body portion 362, which is considered to be within the scope of the present invention.

Figure 11E:
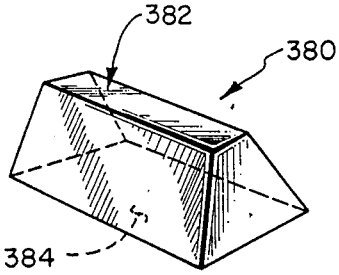

FIG. 11E illustrates yet another booster 380 incorporating teachings of the present invention. Booster 380 has a body portion 382 in the shape of a frustum of a prism. The interface surface 384 of booster 380 substantially coincides with the base of the prism.

Figure 11F:
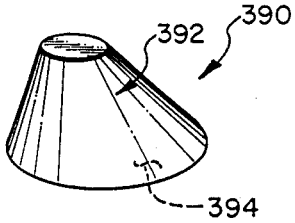

Finally, FIG. 11F depicts a booster 390 having a body portion 392 which is a frustum of an asymmetrically generated cone. The larger planar face of the frustum comprising the base thereof substantially coincides with interface surface 394 of booster 390.

Figure 12A:
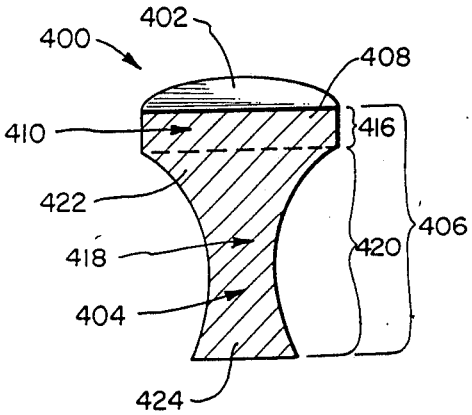
FIGS. 12A–12D are cross-sectional perspective views of various rotationally symmetric alternate embodiments of an explosive booster having composite body portions and incorporating the teachings of the present invention.

In yet another aspect of the present invention, an explosive booster, such as booster 400 shown in FIG. 12A having a substantially flat interface surface 402 for contacting a package of explosives is provided with a composite body portion 404 having sides 406. As shown by way of example and not limitation, the larger end 408 of composite body portion 404 is formed into a plate-shaped interface support section 410 terminating at one side thereof in a base surface which is substantially coincident with interface surface 402. The sides 416 of interface support section 410 may be substantially normal to interface surface 402. Composite body portion 404 further includes a backing section 418 having sides 420 and larger and smaller ends 422 and 424, respectively. Backing section 418 is joined at larger end 422 thereof to interface support section 410 on the side thereof opposite from interface surface 402.

Sides 406 of composite body portion 404 thus comprise sides 416 substantially normal to interface surface 402 and curved sides 420 of backing section 418. Nevertheless, booster according to the present invention should be understood to include sides, such as sides 406, which are a combination of curved sides,such as sides 420, and relatively short, albeit nontapering sides, such as sides 416 of a plate-like interface support section. It is adequate for purposes of the present invention if a composite body portion, such as composite body portion 404, has a cross-sectional area that reduces in an overall manner from the interface surface of that booster to the smaller end of the backing section.

Sides 420 of backing section 418 do not taper at each point thereof, but flare outwardly for a short distance at smaller end 424 of backing section 418. Nevertheless, in according to the present invention the sides of a backing section, such as backing section 418, should be understood to include sides, such as sides 420 that enclose a backing section that has a cross-sectional area that reduces an overall manner from a larger end, such as larger end 422, to a smaller end, such as smaller end 424.

While it is not a requirement of the teachings of the present invention, the area of the cross-section of larger end 422 of backing section 418 is equal to the area of the cross-section of interface surface support section 410 at the side thereof opposite from interface surface 402. Other embodiments of inventive boosters having composite body portions, such as composite body portion 404, have other relative relationships between the areas of these two cross-sections.

Figure 12B:
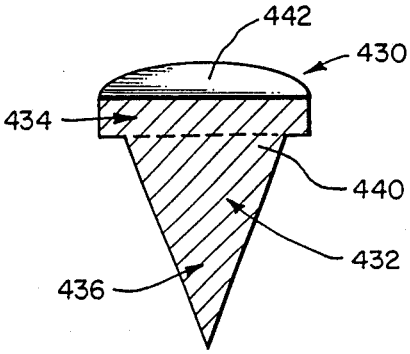

For example, FIG. 12B illustrates an explosive booster 430 having a composite body portion 432 comprising a plate-shaped interface support section 434 and a backing section 436 in the shape of a cone. The base or larger end 440 of conical backing section 436 is joined to interface support section 434 at the side thereof opposite the interface surface 442 of booster 430. In booster 430, the area of the cross-section of backing section 436 at larger end 440 thereof is less than the area of the cross-section of interface support section 434 at the side thereof opposite from interface surface 442.

Figure 12C:
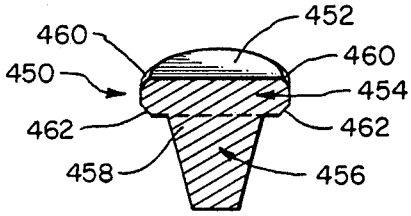

FIG. 12C depicts a related alternative embodiment of a booster 450 according to the present invention. Booster 450 includes an interface surface 452, a plate-shaped interface surface support section 454, and a backing section 456 taking the form of a frustum of a cone. The base or larger end 458 of backing section 456 is joined to interface support section 454 on the side thereof opposite from interface surface 452. In this instance, the periphery of interface surface 452 is provided with beveled edges 460. Similar beveled edges 462 are provided at the periphery of interface support section 454 on the side thereof opposite from interface support surface 452.

Figure 12D:
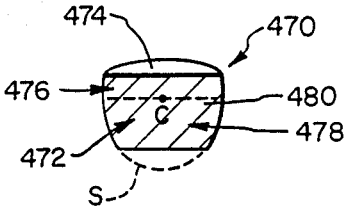

FIG. 12D depicts yet another booster 470 according to the teachings of the present invention having a composite body portion 472. Substantially flat interface surface 474 is formed on one side of an interface surface support section 476. A backing section 478 taking the form of a frustum of a spherical segment of a sphere S having center C is joined at the base or larger end 480 thereof to the side of interface surface support section 476 opposite from interface surface 474. Booster 470 illustrates the special case in which backing section 478 is a frustum of a hemisphere. The cross-section of backing section 478 at larger end 480 thereof is equal to the cross-section of interface surface support section 476.

The explosive boosters depicted in FIGS. 12A–12D and having composite body portions are all rotationally symmetric. Nevertheless, explosive boosters are possible within the teachings of the present invention that have composite body portions in which either or both the interface surface support section and the backing section are rotationally asymmetric. The boosters shown in FIGS. 13A–13C are of this latter type.

Figure 13A:
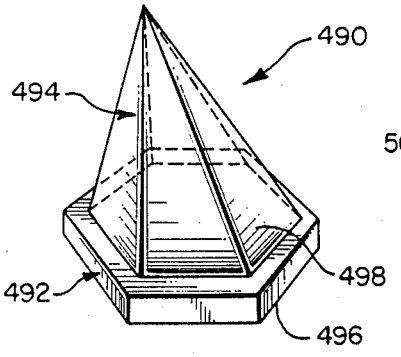
FIGS. 13A–13C are perspective views of various rotationally asymmetrical alternative embodiments of an explosive booster having composite body portions and incorporating teachings of the present invention.

Booster 490 shown in FIG. 13A comprises a plate-shaped interface surface support section 492 and a backing section 494 taking the form of a six-sided pyramid joined thereto. In the embodiment shown, while the cross-section of interface surface support section 492 on the side thereof opposite from interface surface 496 of booster 490 is similar in shape to the six-sided base or larger end 498 of backing section 494, the area of that cross-section of the interface surface support section is larger than that of the cross-section of larger end 496 of backing section 494.

Figure 13B:
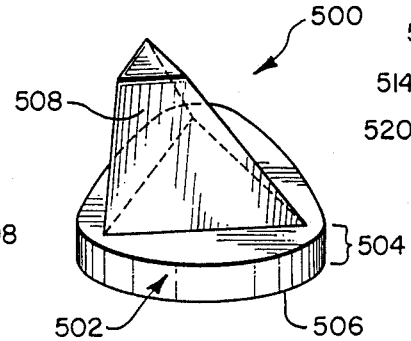

In FIG. 13B, booster 500 embodying teachings of the present invention includes an interface surface support section 502 having continuously curved sides 504. On the side of interface surface support section 502 opposite from the interface surface 506 of booster 500 is a backing section 508 formed as a frustum of a three-sided pyramid, the base of which is joined to interface surface support section 502.

Figure 13C:
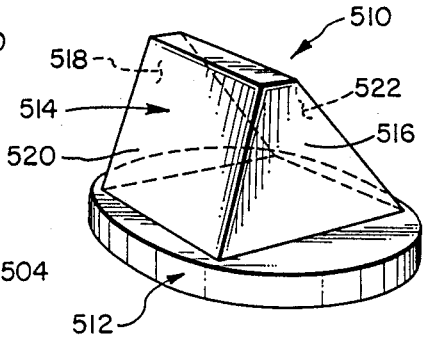

In FIG. 13C, booster 510 is shown comprising a rotationally symmetric, circular plate-like interface surface support section 512 and a backing section 514. Backing section 514 is in the form of a frustum of a prism having ends 516, 518 generally normal to interface surface support section 512 and faces 520, 522 inclined relative thereto.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A booster for use with a means for detonating the booster to explode a column of explosives filling a longitudinal portion of a borehole, said booster comprising:

(a) an interface surface at one end of said booster configured to contact the column of explosives while being directed toward the majority of the explosives in the column of explosives with said interface surface oriented normal to the longitudinal axis of the borehole; and (b) a body portion having said interface surface as a first end thereof and having sides tapering to a second end thereof, said second end having a cross-sectional area smaller than that of said interface surface and being configured to be on the side of the interface surface opposite the majority of the explosives in the column of explosives, the distance between said second end and said interface surface defining the height of said booster, and the volume of said body portion being in the range of from about one-third to about two-thirds of the volume of a reference booster having an equal height, an identical interface surface, and sides normal thereto; and (c) means for engaging the booster with said means for detonating the booster, such that said means for engaging orients the interface surface of the booster to be directed toward the majority of explosives in the column of explosives and said body portion to be on the side of said interface surface opposite the majority of the explosives in the column of explosives.

2. A booster as recited in claim 1, wherein said body portion is a pyramid having said interface surface as the base thereof.

3. A booster as recited in claim 1, wherein said body portion is a frustum of a pyramid having said interface surface as the base thereof.

4. A booster as recited in claim 1, wherein said body portion is a tetrahedron having said interface surface as the base thereof.

5. A booster as recited in claim 1, wherein said body portion is a frustum of a tetrahedron having said interface surface as the base thereof.

6. A booster as recited in claim 1, wherein said means for detonating comprises a detonating cord.

7. A booster as recited in claim 1, wherein said means for detonating comprises a blasting cap.

8. A booster as recited in claim 1, wherein said means for engaging comprises a plurality of passageways formed in said body portion for receiving in operable engagement therewith said means for detonating said booster.

9. A booster as recited in claim 8, wherein one of said passageways is a dead-end receptacle for a blasting cap.

10. A booster as recited in claim 1, wherein said body portion is symmetric about a longitudinal axis normal to said interface surface.

11. A booster as recited in claim 10, wherein said interface surface is circular.

12. A booster as recited in claim 11, wherein said body portion is a cone having said interface surface as the base thereof.

13. A booster as recited in claim 11, wherein said body portion is a frustum of a cone having said interface surface as the base thereof.

14. A booster as recited in claim 11, wherein said body portion is a parabolic solid having said interface surface as the base thereof.

15. A booster as recited in claim 11, wherein said body portion is an elliptical solid having said interface surface as the base thereof.

16. A booster as recited in claim 11, wherein said body portion is a hemisphere having said interface surface as the planar surface thereof.

17. A booster as recited in claim 11, wherein said body portion is a frustum of a spherical segment said interface surface having as the base thereof.

18. A booster for use with a means for detonating the booster to explode a column of explosives filling a longitudinal portion of a borehole, said booster comprising:

(a) a quantity of selectively detonatable high energy material formed into a body portion terminating at one end thereof in an interface surface for contacting and being directed toward the majority of the explosives in the column of explosives with said interface surface oriented normal to the longitudinal axis of the borehole and with the other end of said body portion being on the opposite side of said interface surface from the majority of the explosives in the borehole, the area of the cross-section of said booster and any plane parallel to said interface surface diminishing with the distance of said plane therefrom, and the volume of said booster being in the range of from about one-third to about two thirds of the volume of a reference booster having an equal height, an identical interface surface, and sides normal thereto; and (b) means for engaging the booster with said means for detonating the booster, such that said means for engaging orients the interface surface of the booster to be directed toward the majority of explosives in the column of explosives and said body portion to be on the side of said interface surface opposite the majority of the explosives in the column of explosives.

19. A booster as recited in claim 18, wherein said interface surface is circular and said booster is symmetric about an axis normal to the center of said circle.

20. A booster as recited in claim 19, wherein said body portion is a frustum of a cone having said interface surface as the base thereof.

21. A booster for effecting the high-efficiency detonation of a column of explosives filling a longitudinal portion of a borehole, said booster comprising:

(a) a quantity of selectively detonatable high energy material formed into a frustoconical shape, the base of said frustoconical shape functioning as an interface surface for contacting the column of explosives and being directed toward the majority of the explosives in the column of explosives with said interface surface oriented normal to the longitudinal axis of the borehole, the volume of said frustoconical shape being in the range of about one-third to about two-thirds of the volume of a reference booster having an equal height, an identical interface surface, and sides normal thereto; and (b) means for engaging the booster with a means for detonating the booster to explode the column of explosives, such that said means for engaging orients the interface surface of the booster to be directed toward the majority of explosives in the column of explosives and said frustoconical shape to be on the side of said interface surface opposite the majority of the explosives in the column of explosives.

22. A device for producing a substantially planar detonating wave in a column of explosives filling a longitudinal portion of a borehole, said device comprising:

(a) a booster in contact with the explosives, said booster comprising a quantity of selectively detonatable high energy material formed into a body portion terminating at one end thereof in an interface surface for contacting and being directed toward the majority of the explosives in the column of explosives with said interface surface oriented normal to the longitudinal axis of the borehole, the area of the cross-section of said booster in any plane parallel to said interface surface diminishing with the distance of said plane therefrom, and the volume of said booster being in the range of from about one-third to about two-thirds of the volume of a reference booster having a base identical to said interface surface, a height identical to the height of said body portion, and sides normal to the base;

(b) means for detonating said booster to generate a shockwave front and to propagate said shockwave front into the column of explosives; and (c) means for engaging the booster with said means for detonating said booster, such that said means for engaging the booster orients said interface surface to be directed toward the majority of explosives in the column of explosives and said body portion to be on the side of the interface surface opposite the majority of the explosives in the column of explosives.

23. A device for producing a substantially planar detonating wave front in a column of explosives filling at least a longitudinal portion of a borehole, said device comprising:

(a) a booster in contact with the explosives, said booster comprising:

(i) a quantity of selectively detonatable high energy material formed into a body portion terminating at one end thereof in an interface surface for contacting and being directed toward the majority of the explosives in the column of explosives with said interface surface oriented normal to the longitudinal axis of the borehole, said booster having a volume in the range of about one-third to about two-thirds of the volume of a reference cylinder having a base identical to said interface surface, a height identical to the height of said body portion, and sides normal to the base;

(b) means for detonating said booster to generate a shockwave front and to propagate said shockwave front into the column of explosives; and (c) means for engaging the booster with said means for detonating said booster, such that said means for engaging the booster orients said interface surface to be directed toward the majority of explosives in the column of explosives and said body portion to be on the side of said interface surface opposite the majority of the explosives in the column of explosives.

24. A device as recited in claim 23, wherein said booster is a cone having said interface surface as a base thereof.

25. A booster as recited in claim 23, wherein said body portion is a frustum of a cone having said interface surface as the base thereof.

26. A booster as recited in claim 25, wherein said high energy detonatable material is Pentolite.

27. A method for increasing the detonation efficiency of a given quantity of selectively detonatable high energy material in relation to a column of explosives filling at least a longitudinal portion of a borehole, said method comprising the steps of:

(a) forming the quantity of selectively detonatable high energy material into a booster comprising:

(i) an interface surface at one end of said booster for contacting and being directed toward the column of explosives with said interface surface oriented normal to the longitudinal axis of the borehole;

(ii) a body portion having said interface surface as a first end thereof and having sides tapering to a second end thereof opposite from and smaller than said interface surface, the distance between said second and an said interface surface defining the height of said booster, the volume of said body portion being significantly less than the volume of a reference booster having an equal height, an identical interface surface, and sides normal thereto; and (iii) at least one passageway formed in said body portion of said booster for receiving in operative engagement therewith means for detonating said booster;

(b) installing said means for detonating in said at least one passageway in operable engagement with said booster;

(c) locating said booster and said means for detonating operatively engaged therewith in the borehole contacting and being directed toward the column of explosives with said interface surface oriented normal to the longitudinal axis of said borehole; and (d) activating said means for detonating to explode said booster and to generate a detonating wave front through the column of explosives with a relatively short run-up distance, thereby to detonate the column of explosives efficiently.

* * * * *